US007102073B1

(12) United States Patent
Isola

(10) Patent No.: US 7,102,073 B1
(45) Date of Patent: Sep. 5, 2006

(54) GUITAR COMBO

(76) Inventor: Oluwabusuyi Isola, 10842 Jean St., Anaheim, CA (US) 92804

( * ) Notice: Subject to any disclaimer, the term of this patent is extended or adjusted under 35 U.S.C. 154(b) by 203 days.

(21) Appl. No.: 10/850,608

(22) Filed: May 20, 2004

(51) Int. Cl.
*G10H 3/00* (2006.01)

(52) U.S. Cl. ..... 84/723; 84/263; 84/267; 84/453; 84/743

(58) Field of Classification Search ..... 84/723, 84/293, 263, 267, 291, 743, 453
See application file for complete search history.

(56) References Cited

U.S. PATENT DOCUMENTS

| | | | | | |
|---|---|---|---|---|---|
| 1,723,751 | A * | 8/1929 | Turturro | ..... | 84/263 |
| 4,121,494 | A * | 10/1978 | Reno et al. | ..... | 84/453 |
| 4,240,319 | A * | 12/1980 | Soupios | ..... | 84/263 |
| 4,343,217 | A * | 8/1982 | Brody | ..... | 84/743 |
| 4,377,101 | A * | 3/1983 | Santucci | ..... | 84/743 |
| 4,785,705 | A * | 11/1988 | Patterson | ..... | 84/726 |
| 4,987,815 | A | 1/1991 | Shockley | | |
| 5,251,526 | A * | 10/1993 | Hill | ..... | 84/263 |
| 5,315,910 | A * | 5/1994 | Soupios | ..... | 84/453 |
| 6,346,661 | B1 * | 2/2002 | Yaskoweak | ..... | 84/267 |
| 2003/0159562 | A1 * | 8/2003 | Bailey | ..... | 84/293 |
| 2003/0188622 | A1 * | 10/2003 | Wilson | ..... | 84/267 |

* cited by examiner

*Primary Examiner*—Lincoln Donovan
*Assistant Examiner*—Christina Russell

(57) ABSTRACT

A combination stringed musical instrument for providing different stringed instruments on a common housing. The instrument includes a housing, neck portion, head portion, first plurality of string and second plurality of strings. The neck portion includes a neck first side and a neck second side. The head portion may be operationally coupled to the neck portion. The head portion includes a head first side and head second side. The head portion includes a plurality of tuning pegs. The first plurality of strings is preferably operationally coupled to the first side of the housing and extends upwardly along the neck first side. The first plurality of strings is coupled to the head first side. Similarly, the second plurality of strings may also be coupled to the second side of the housing and extends upwardly along the neck second side. The second plurality of strings is coupled to the head second side.

11 Claims, 3 Drawing Sheets

GUITAR COMBO

I. BACKGROUND OF THE INVENTION

The present invention relates to guitars and more particularly pertains to a new combination stringed musical instrument for providing two stringed guitars on a common housing.

II. DESCRIPTION OF THE PRIOR ART

The use of combination musical instruments is known in the prior art. Illustrative examples include U.S. Pat. No. 4,377,101; U.S. Pat. No. 4,987,814; and U.S. Pat. No. 6,346,661.

III. SUMMARY OF THE INVENTION

The present invention meets the needs presented above by utilizing a single neck with strings positioned on the front and the back of the neck with a cover member selectively covering the currently unused strings and providing a resting surface for the palm of the users hand while manipulating the currently used strings against the neck and frets.

To this end, the present invention generally comprises includes a housing, neck portion, head portion, first plurality of string and second plurality of strings. The neck portion includes a neck first side and a neck second side. The head portion may be operationally coupled to the neck portion. The head portion includes a head first side and head second side. The head portion includes a plurality of tuning pegs. The first plurality of strings is preferably operationally coupled to the first side of the housing and extends upwardly along the neck first side. The first plurality of strings is coupled to the head first side. Similarly, the second plurality of strings may also be coupled to the second side of the housing and extends upwardly along the neck second side. The second plurality of strings is coupled to the head second side.

There has thus been outlined, rather broadly, the more important features of a musical instrument in order that the detailed description thereof that follows may be better understood, and in order that the present contribution to the art may be better appreciated. There are additional features of the musical instrument that will be described hereinafter and which will form the subject matter of the claims appended hereto In this respect, before explaining at least one embodiment of the musical instrument in detail, it is to be understood that the musical instrument is not limited in its application to the details of construction and to the arrangements of the components set forth in the following description or illustrated in the drawings. The musical instrument is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present musical instrument. It is important, therefore, that the claims be regarded as including such equivalent constructions insofar as they do not depart from the spirit and scope of the present invention.

It is another object of the present invention to provide a musical instrument which has all of the advantages of the prior art and none of the disadvantages.

It is another object of the present invention to provide a musical instrument which may be easily and efficiently manufactured and marketed.

It is another object of the present invention to provide a musical instrument which is of durable and reliable construction.

It is yet another object of the present invention to provide a musical instrument which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
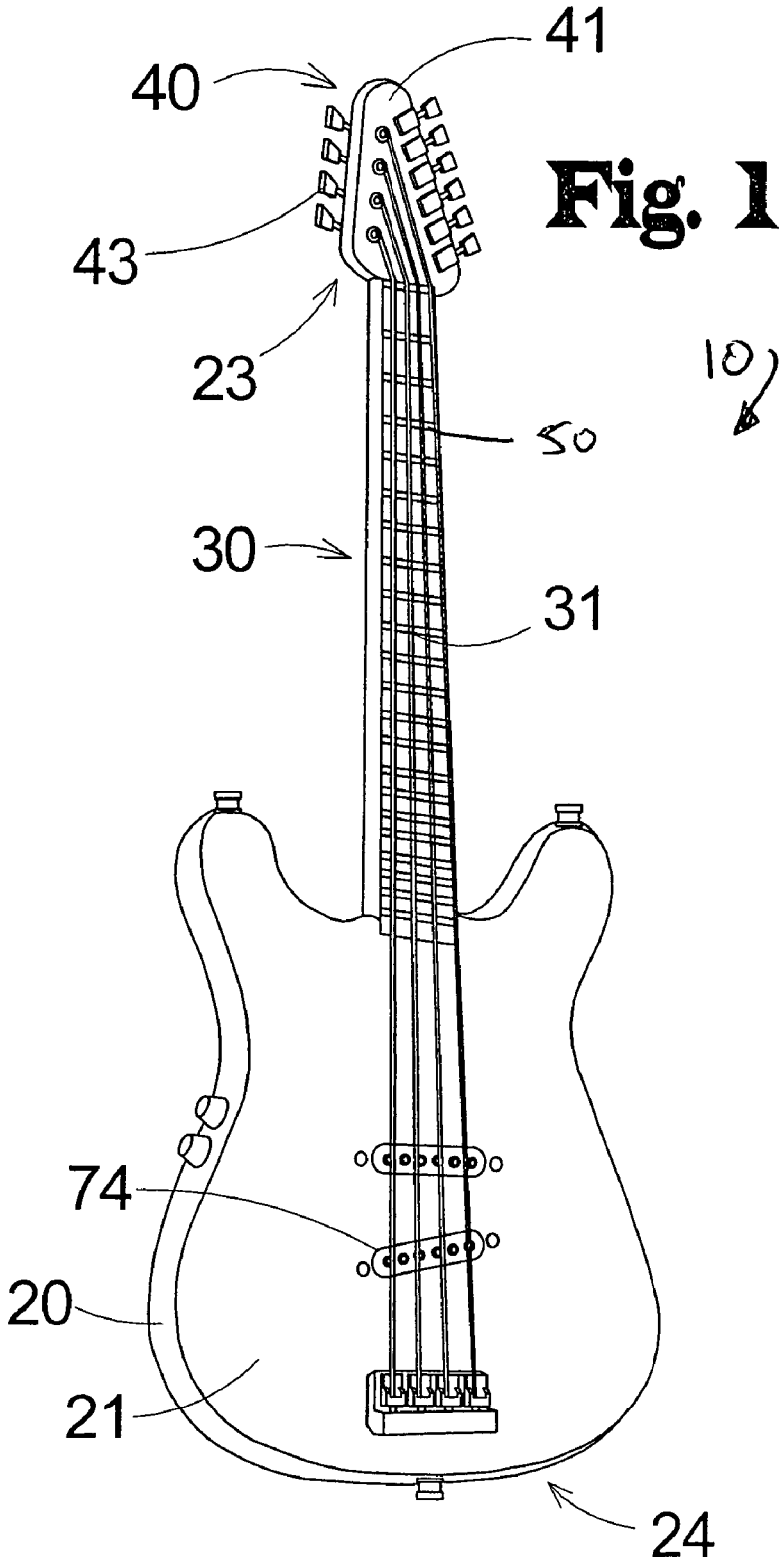
FIG. 1 is a schematic perspective view of a first side of a new combination stringed musical instrument according to the present invention.
Figure 2:
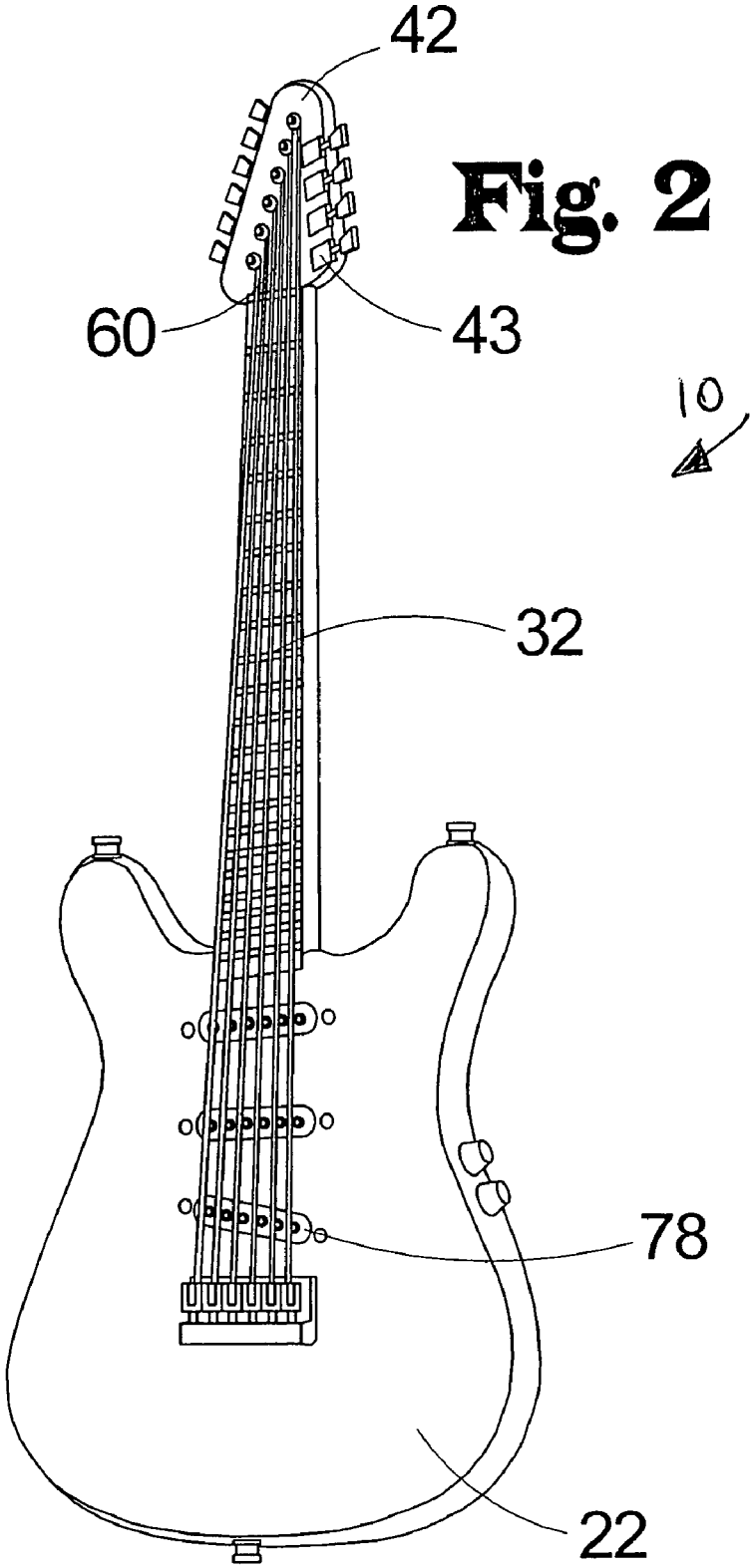
FIG. 2 is a schematic perspective view of a second side of the present invention.
Figure 3:
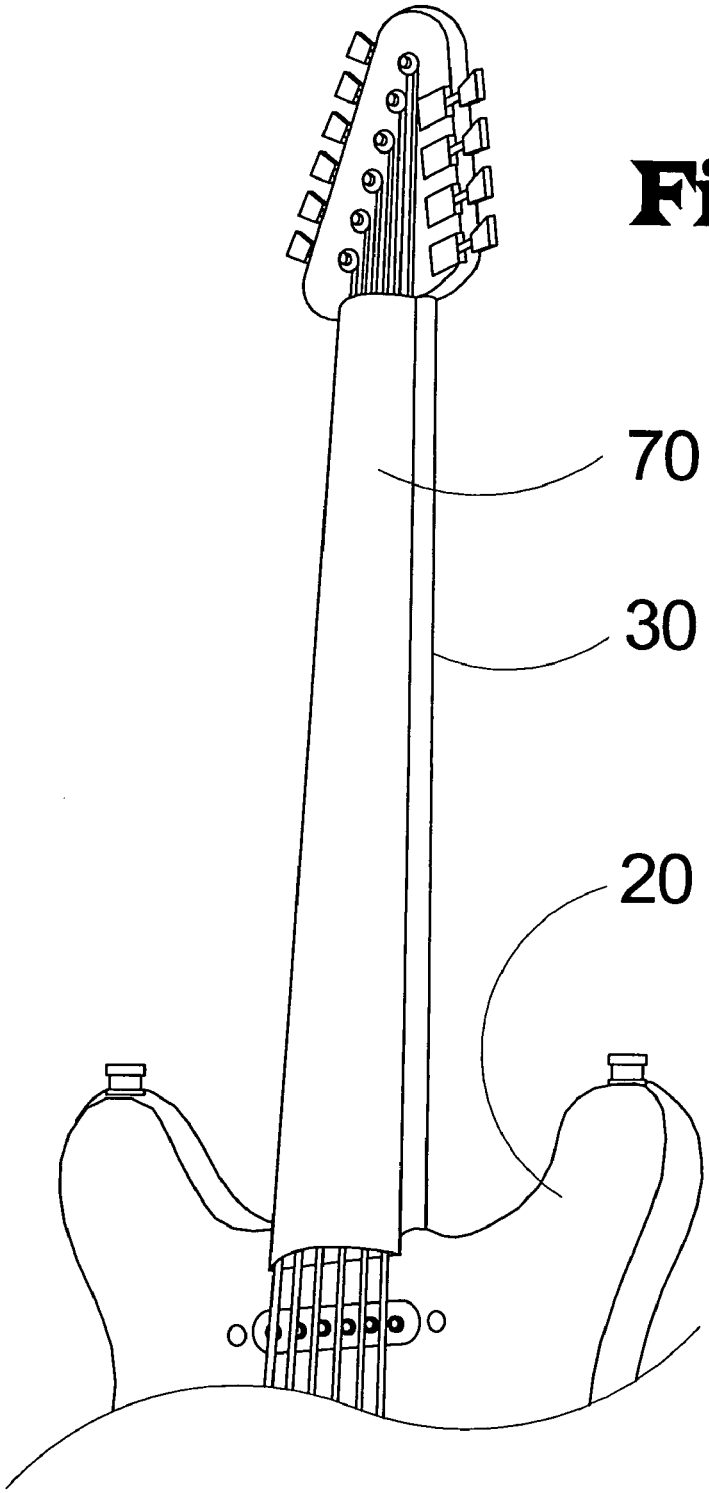
FIG. 3 is a schematic perspective view of the string cover member of the present invention.

With reference now to the drawings, and in particular to FIGS. 1 through 3 thereof, a new combination stringed musical instrument embodying the principles and concepts of the present invention and generally designated by the reference numeral 10 will be described.

As best illustrated in FIGS. 1 through 3, the combination stringed musical instrument 10 generally comprises a housing 20, a neck portion 30, a head portion 40, a first plurality of string 50 and a second plurality of strings 60.

The housing 20 includes a first side 21 and a second side 22. The housing 20 also includes an upper end 23 and a lower end 24.

The neck portion 30 may be operationally coupled to the upper end 23 of the housing 20. The neck portion 30 includes a neck first side 31 and a neck second side 32.

The head portion 40 may be operationally coupled to the neck portion 30. The head portion 40 includes a head first side 41 and a head second side 42. The head portion 40 includes a plurality of tuning pegs 43.

The first plurality of strings 50 is preferably operationally coupled to the first side 21 of the housing 20 and extends upwardly along the neck first side 31. The first plurality of strings 50 is operationally coupled to the head first side 41.

Similarly, The second plurality of strings 60 may also be operationally coupled to the second side 22 of the housing 20 and extends upwardly along the neck second side 32. The second plurality of strings 60 is operationally coupled to the head second side 42.

In a preferred embodiment, the first plurality of strings 50 comprises six strings and the housing 20, neck first side 31, first plurality of strings 50, and the head first side 41 form a rhythm guitar.

In a further preferred embodiment, the second plurality of strings 60 comprises four strings; and the housing 20, neck second side 32, second plurality of strings 60, and the head second side 42 form a bass guitar.

A string cover member 70 may operationally coupleable to the neck portion 30. The string cover member 70 may be positioned to selectively cover the first plurality of strings 50 when a user is playing the second plurality of strings 60, or positioned to selectively cover the second plurality of strings 60 when the user is playing the first plurality of strings 50. The string cover member 70 provides a support surface for a palm of the user while manipulating either the first plurality of strings 50 or the second plurality of strings 60.

An electric pickup 74 may be positioned adjacent to the first plurality of strings 50 in order to facilitate amplification of sounds created by any one of the first plurality of strings 50.

Similarly, a second electric pickup 78 may also be positioned adjacent to the second plurality of strings 60, to facilitate amplification of sounds created by any one of the second plurality of strings 60.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination stringed musical instrument comprising:

a housing having a first side surface, a second side surface, an upper end, and a lower end, the first side surface facing a first direction and the second side surface facing a second direction, the first direction being opposite the second direction, a neck portion operationally coupled to said upper end of said housing, said neck portion having a neck first side surface and a neck second side surface, the neck first side surface facing a first direction and the neck second side surface facing a second direction, the first direction being opposite the second direction, a head portion operationally coupled to said neck portion, said head portion having a head first side surface and a head second side surface, said head portion having a plurality of tuning pegs, the head first side surface facing a first direction and the head second side surface facing a second direction, the first direction being opposite the second direction, a first plurality of strings operationally coupled to said first side surface of said housing and extending upwardly along said neck first side surface, said first plurality of strings being operationally coupled to said head first side surface, and a second plurality of strings operationally coupled to said second side surface of said housing and extending upwardly along said neck second side surface, said second plurality of strings being operationally coupled to said head second side surface.

2. The combination stringed musical instrument of claim 1, wherein said first plurality of strings comprises six strings.

3. The combination stringed musical instrument of claim 2, wherein said housing, neck first side, first plurality of strings, and said head first side form a rhythm guitar.

4. The combination stringed musical instrument of claim 1, wherein said second plurality of strings comprises four strings.

5. The combination stringed musical instrument of claim 4, wherein said housing, neck second side, second plurality of strings, and said head second side form a bass guitar.

6. The combination stringed musical instrument of claim 1, further wherein:

said first plurality of strings comprises six strings;

said housing, neck first side, first plurality of strings, and said head first side form a rhythm guitar;

said second plurality of strings comprises four strings; and said housing, neck second side, second plurality of strings, and said head second side form a bass guitar.

7. The combination stringed musical instrument of claim 6, further comprising a string cover member operationally coupleable to said neck portion, said string cover member being positionable to selectively cover said first plurality of strings when a user is playing said second plurality of strings, said string cover member being positionable to selectively cover said second plurality of strings wherein the user is playing said first plurality of strings, said string cover member providing a support surface for a palm of the user while manipulating either said first plurality of strings or said second plurality of strings.

8. The combination stringed musical instrument of claim 1, further comprising a string cover member operationally coupleable to said neck portion, said string cover member being positionable to selectively cover said first plurality of strings when a user is playing said second plurality of strings, said string cover member being positionable to selectively cover said second plurality of strings wherein the user is playing said first plurality of strings, said string cover member providing a support surface for a palm of the user while manipulating either said first plurality of strings or said second plurality of strings.

9. The combination stringed musical instrument of claim 1, further comprising an electric pickup positioned adjacent to said first plurality of strings, said electric pickup facilitating amplification of sounds created by any one of said first plurality of strings.

10. The combination stringed musical instrument of claim 1, further comprising a second electric pickup positioned adjacent to said second plurality of strings, said electric pickup facilitating amplification of sounds created by any one of said second plurality of strings.

11. The combination stringed musical instrument of claim 1 wherein the combination stringed musical instrument further comprises:

a string cover member operationally coupleable to said neck portion, an electric pickup positioned adjacent to said first plurality of strings, a second electric pickup positioned adjacent to said second plurality of strings, wherein said first plurality of strings comprises six strings, further wherein said housing, neck first side, first plurality of strings, and said head first side form a rhythm guitar, further wherein said second plurality of strings comprises four strings, further wherein said housing, neck second side, second plurality of strings, and said head second side form a bass guitar, further wherein said string cover member is positionable to selectively cover said first plurality of strings when a user is playing said second plurality of strings, said string cover member being positionable to selectively cover said second plurality of strings wherein the user is playing said first plurality of strings, said string cover member providing a support surface for a palm of the user while manipulating either said first plurality of strings or said second plurality of strings, further wherein said electric pickup facilitates amplification of sounds created by any one of said first plurality of strings, and further wherein said second electric pickup facilitates amplification of sounds created by any one of said second plurality of strings.

* * * * *